US006215966B1

(12) United States Patent
Yang et al.

(10) Patent No.: US 6,215,966 B1
(45) Date of Patent: Apr. 10, 2001

(54) APPARATUS AND METHOD TO IDENTIFY REPLACEMENT OF DEVELOPING MACHINE

(75) Inventors: Chul-Joo Yang, Daegu; Sung-Guen Park, Kyeonsangbook-do, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/396,939

(22) Filed: Sep. 15, 1999

(30) Foreign Application Priority Data

Sep. 15, 1998 (KR) ..... 98-38030

(51) Int. Cl.[7] ..... G03G 21/00
(52) U.S. Cl. ..... 399/27; 399/43
(58) Field of Search ..... 399/27, 24, 25, 399/43, 111

(56) References Cited

U.S. PATENT DOCUMENTS 5,021,828 * 6/1991 Yamaguchi et al. ..... 399/24
5,315,351 * 5/1994 Matsushiro et al. ..... 399/49
5,740,491 * 4/1998 Imai ..... 399/25
5,758,224 * 5/1998 Binder et al. ..... 399/25
5,835,817 * 11/1998 Bullock et al. ..... 399/25

* cited by examiner

*Primary Examiner*—Quana M. Grainger
(74) *Attorney, Agent, or Firm*—Robert E. Bushnell, Esq.

(57) ABSTRACT

An apparatus to identify a replacement of a developing machine comprises a fuse which is disposed at a desired position of the developing machine; a switching part which is disposed at a desired position of a printer body corresponding to the fuse and applies a level of current to the fuse according to a control signal so as to disconnect the fuse; a control unit which outputs a control signal to the switching part so as to check whether the fuse is disconnected when a warming-up operation of a printer is started, and which outputs a control signal to a power controller so as to disconnect the fuse if the fuse is not disconnected and then initializes a printing counter, wherein the developing machine is determined to have been replaced, if the fuse is not disconnected.

17 Claims, 4 Drawing Sheets

APPARATUS AND METHOD TO IDENTIFY REPLACEMENT OF DEVELOPING MACHINE

CLAIM OF PRIORITY

This application makes reference to, incorporates the same herein, and claims all benefits accruing under 35 U.S.C. §119 from an application entitled APPARATUS AND METHOD TO IDENTIFY REPLACEMENT OF DEVELOPING MACHINE earlier tiled in the Korean Industrial Property Office on Sep. 15, 1998, and there duly assigned Ser. No. 38030/1998.

BACKGROUND OF THE INVENTION

1. Field of the Invention

The present invention relates to the field of electrophotographic devices, and more particularly to an apparatus and method to recognize when a developing machine is replaced in an electrophotographic apparatus.

2. Description of the Related Art

Generally, in an electrophotographic apparatus such as a copying machine or a laser printer, a photosensitive drum is charged to a high voltage by a high voltage charging roller. Then, an electrostatic latent image is formed on the photosensitive drum by a ray of light from an exposing apparatus such as a laser diode.

At this time, the electrostatic latent image is passed through a developing machine so as to be converted into a visible image formed by toner discharged from the developing machine. The visible image on the photosensitive drum is then transferred to a paper fed by a pickup roller. After the visible image transferred to the paper is thermally fused by heat and pressure of a fixing device, the paper is discharged.

In the laser printer described as above, the developing machine which contains the toner should be replaced after being used for printing a predetermined number of papers. There are two ways for sensing the replacement of the developing machine. One is to provide a separate sensor in the laser printer, to indicate when the developing machine needs to be replaced. However, such a sensor is expensive.

The other way is to continuously count the number of the printed papers after the replacement of the developing machine and to compare the counting number with a printing number corresponding to the life of the developing machine provided by a manufacturer, thereby determining the replacement time of the developing machine. However, in order to identify the replacement time of the developing machine as described above, a counter must be reset. To reset the counter, generally a separate sensor which is expensive should be provided.

In addition to the cost of the sensor itself, the mounting of the separate sensor makes the mechanical construction of the laser printer complicated, and the manufacturing cost is increased.

SUMMARY OF THE INVENTION

It is therefore an object of the present invention to provide an improved electrophotographic apparatus.

It is a further object of the invention to provide an electrophotographic apparatus with an improved apparatus and method for recognizing when a developing machine has been replaced.

It is a yet further object of the invention to provide an electrophotographic apparatus which is simpler in design.

It is a still further object of the invention to provide an electrophotographic apparatus which does not require a sensor to indicate replacement of the developing machine.

It is another object of the present invention to provide an electrophotographic apparatus which is less complex and less expensive to manufacture.

The objects of the present invention are met in the present invention which provides an apparatus and method to identify a replacement of a developing machine which identifies the replacement of the developing machine by confirming whether a fuse provided on the developing machine is disconnected when an upper cover of the printer is opened and then closed or power source is off, and which initializes a counter when the developing machine is replaced with new one, whereby a user can identify the replacement status of the developing machine so as to decide the replacement time of the developing machine without using a separate sensor.

To achieve the above objects and other advantages, there is provided an apparatus to identify a replacement of a developing machine which includes: a fuse which is disposed at a desired position of the developing machine; a switching part which is disposed at a desired position of a printer body corresponding to the fuse and applies a level of current to the fuse according to a control signal so as to disconnect, that is, blow, the fuse; a control unit which outputs a control signal to the switching part so as to check whether the fuse is disconnected when a warming-up operation of a printer is started, and which outputs a control signal to a power controller so as to disconnect the fuse if the fuse is not disconnected and then initializes a printing counter, wherein the developing machine is determined to have been replaced, if the fuse is not disconnected.

Preferably, the control unit comprises a central processing unit which entirely controls the apparatus and a RAM which initializes the printing counter if the fuse is disconnected by the control signal.

Further, it is preferred that the switching part comprises a transistor of which a base is connected with an output terminal and a collector is connected with a power terminal and an emitter is connected with the fuse so that the switching part is turned on if a first level of current is supplied from the CPU and a second level of current is supplied from the power terminal so as to disconnect the fuse; and a diode of which a cathode is connected with an input terminal of the CPU and an anode is connected with the transistor and a node of the fuse so that the diode is turned on by the second level of current through the transistor if the fuse is disconnected.

Further, according to the present invention, there is provided a method to identify a replacement of a developing machine, includes steps of: checking whether a fuse is disconnected when a warning-up operation of a printer is started; disconnecting the fuse and initializing a printing counter if the fuse is not disconnected; increasing a number of the printing counter by one whenever one paper is printed and storing the number in a storing means.

Preferably, the method further comprises a step of outputting the number of the printing counter stored in the storing means if the user inputs an order of checking the number of the printing counter.

It is preferred that the step of checking whether a fuse is disconnected comprises steps of: initializing the number of the printing counter and applying a power to the fuse so as to disconnect the fuse; checking whether the fuse is disconnected; increasing the number of the printing counter if the fuse is not disconnected, and comparing a predetermined standard number with the counting number; outputting an error message if the counting number is same with the standard number, and disconnecting the fuse if the counting number is less than the standard number.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
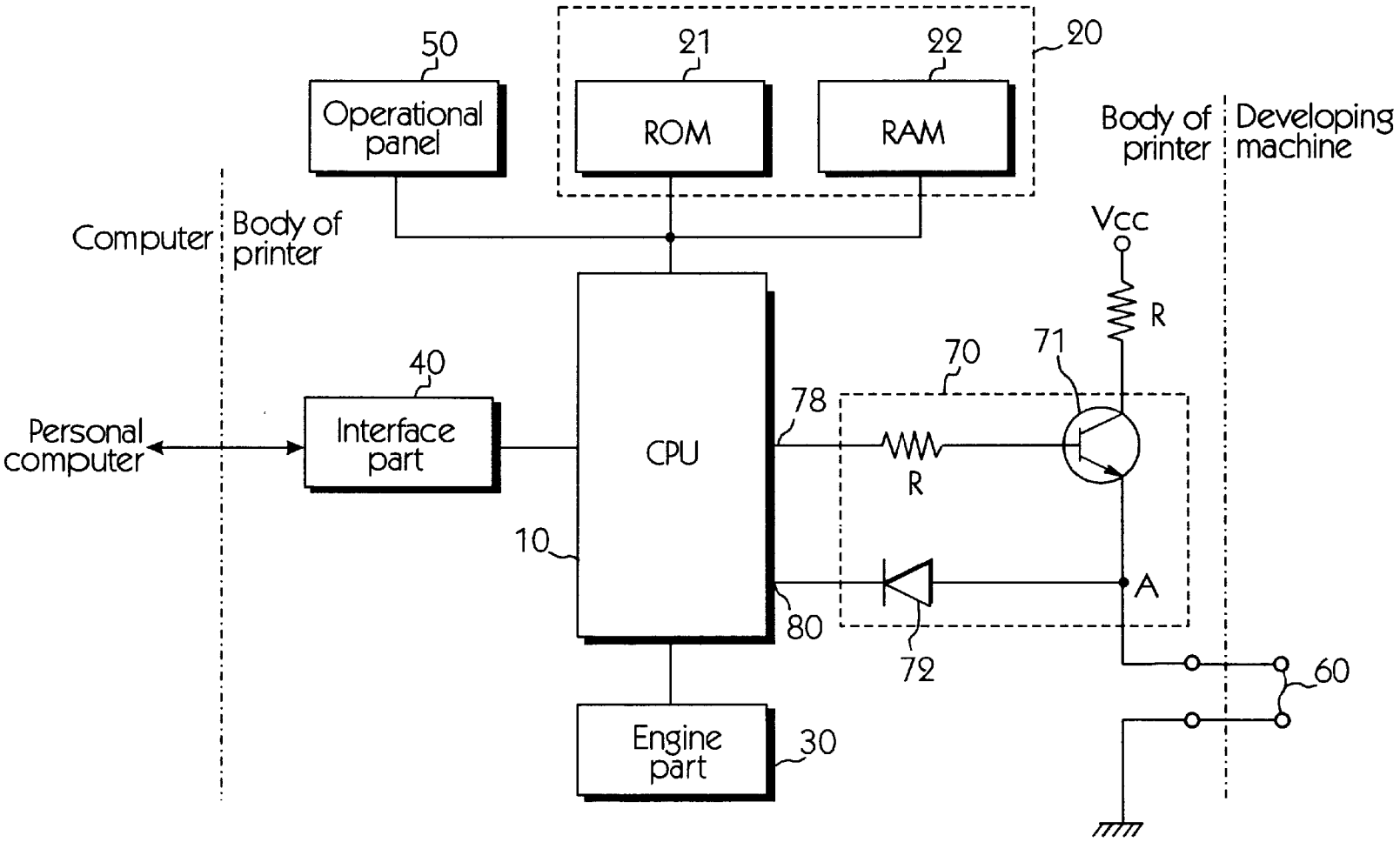
FIG. 1 is a block diagram of a printer according to the present invention.
Figure 2A:
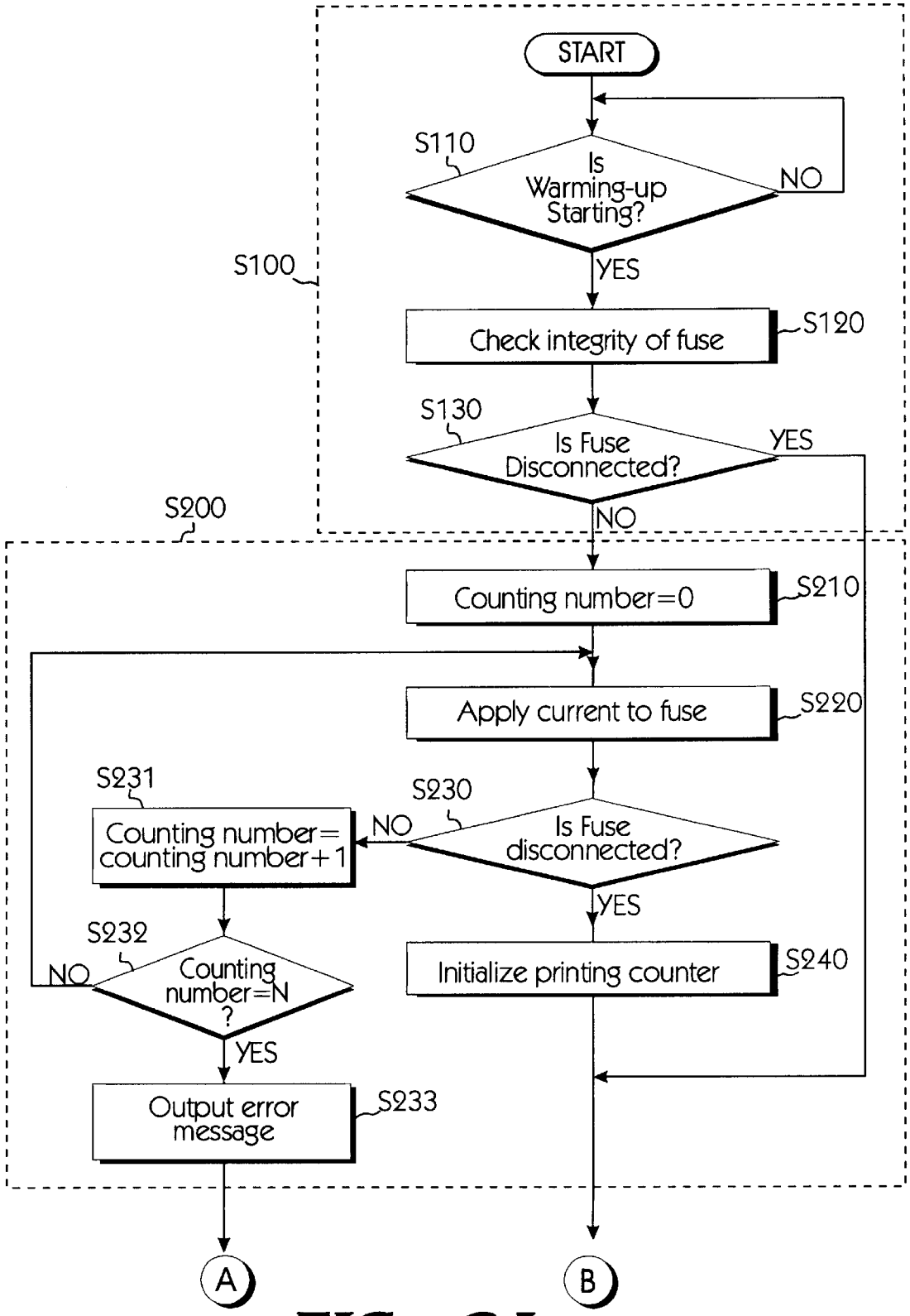
FIGS. 2A and 2B are flow charts showing a way of identifying the replacement of a developing machine according to the present invention.
Figure 2B:
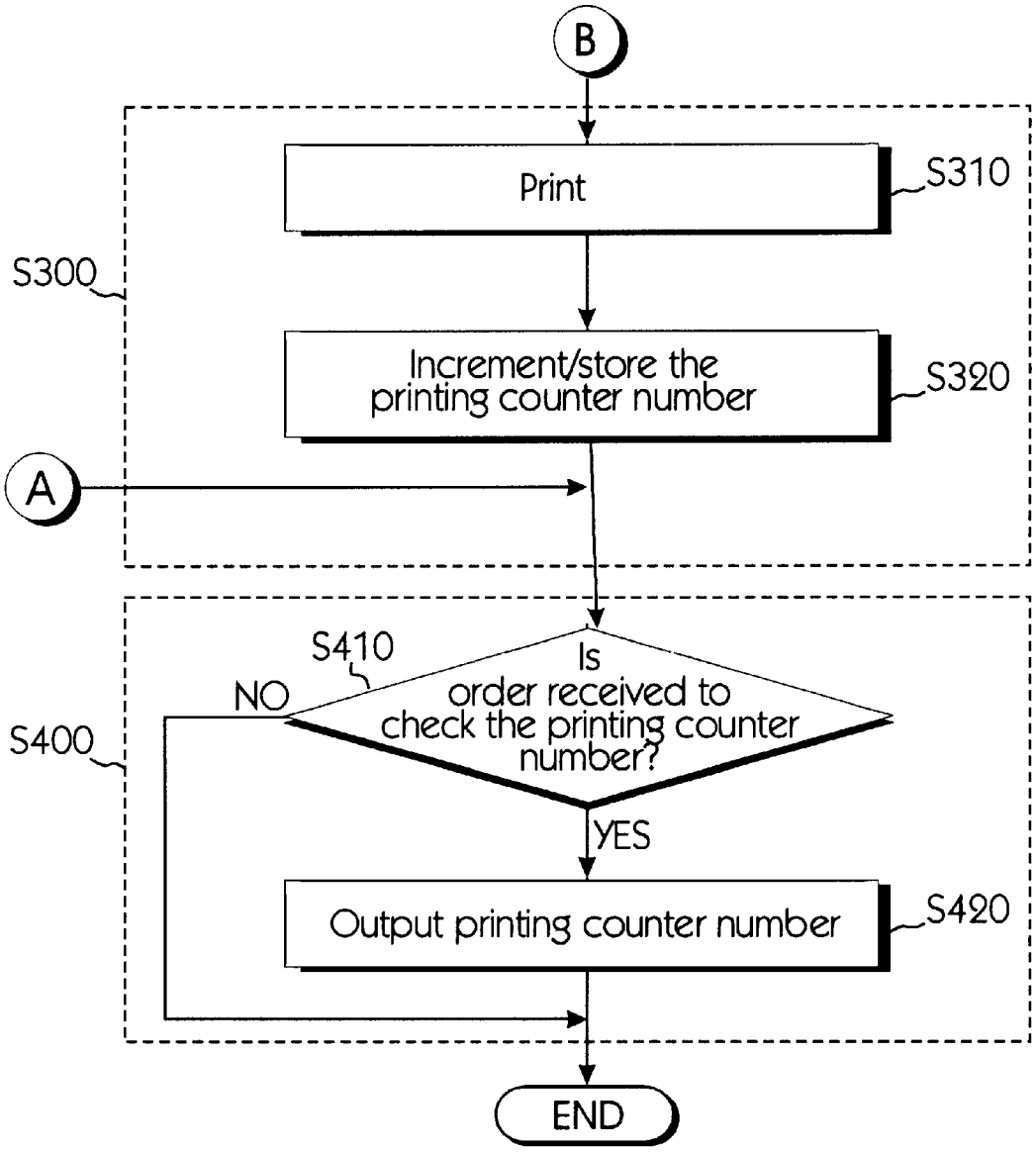

The present invention now will be described more fully hereinafter with reference to the accompanying drawings, in which embodiments of the invention are shown. FIG. 1 is a block diagram of a printer according to the present invention, FIG. 2A and 2B are flow charts showing a way of identifying the replacement of a developing machine according to the present invention.

Referring to FIG. 1, if a document is written out by an application program of a personal computer such as a word processor, the document is converted into a printer command or a printer language by a printer driver and transferred through an interface part 40 to a central processing unit (CPU) 10. The transferred data are converted into image data by the CPU 10 to be finally printed and then temporarily stored in RAM 22 of a memory 20. The image data stored in the RAM 22 are transferred to an engine part 30 and controlled by the CPU 10 to be printed on a paper. Particularly, if a warming-up operation of the printer is started, that is, if an upper cover of the printer is opened and then closed or if a power source which was Off is turned On, a desired level of a current is output to a transistor 71 of a switching part 70 so as to determine whether a fuse 60 is disconnected. Then, if the fuse 60 is not disconnected (i.e., a developing machine has been replaced with a new one), the CPU 10 disconnects the fuse 10 through the switching part 70 and initializes a number of a printing counter stored in the memory 20.

In ROM 21 of the memory 20, there are stored various data and programs necessary to a system. In the RAM 22 of the memory 20, there are temporarily stored the image data. Particularly, if the existing developing machine is replaced with a new one, the existing data stored in the RAM 22 are deleted by the CPU 10.

Further, a state of the printer is displayed through a display window provided in an operational panel 50. An operation of the printer such as an initialization of the printer is controlled by various keys on the operational panel 50.

Meanwhile, the fuse 60 is disposed at one side of the developing machine so as to be disconnected, that is, blown, when current from a power terminal Vcc is applied through the switching part 70. And, a base of the transistor 71 of the switching part 71 is connected with an output end 78 of the CPU 10, its collector is connected with the power terminal Vcc and its emitter is connected with the fuse 60. The transistor 71 receives a first level of current from the CPU 10 and is turned on, thereby supplying a second level of current from the power terminal Vcc to the fuse 60. The second level of current is a minimum, that is, small but sufficient, current for disconnecting the fuse 60.

The cathode of a diode 72 of the switching part 70 is connected with an input terminal 80 of the CPU 10 and the anode of the diode is connected to a node A between the transistor 71 and the fuse 60. Therefore, if the fuse 60 is disconnected, the diode 72 is turned on by the second level of current applied through the transistor 71.

The operation of the apparatus to identify the replacement of the developing machine will be described more fully referring to FIG. 2. First of all, the CPU 10 determines whether the warming-up operation of the printer is started (S110). If the warming-up is started, the first level of current is supplied to the base of the transistor 71 so as to turn on the transistor 71, thereby checking whether the fuse 60 of the developing machine is disconnected (S120). And if the fuse 60 is not disconnected, i.e., an old developing machine has been replaced with a new one (S130) having an intact fuse, the CPU 10 initializes the counting number to "0" (S210). And the second level of current is then supplied through the transistor 71 to the fuse 60 so as to attempt to blow the fuse 60 (S220).

If the fuse is a shape-memory type, the time necessary to blow the fuse is very short, usually less than several seconds. If the fuse is a simple wire type, the time to blow the fuse may be longer than one second.

Several attempts may be necessary to blow the fuse. Therefore, the CPU 10 then determines whether the fuse 60 is disconnected, that is, blown. If the fuse 60 is disconnected (S230), the CPU 10 initializes the existing number of the printing counter stored in the RAM 22 of the memory 20 (S240).

After that, if a printing order is received and a printing operation is performed (S310), the number of the printing counter is incremented, for example, increased by one, whenever one paper is printed and the value is stored in the RAM 22.

In addition, if the user inputs an order to check the printing counter number of the developing machine through a key on the operational panel 50 (S410), the CPU 10 controls the engine part 30 to output the number of the printing counter stored in the RAM 22. This number indicates how much the developing machine has been used.

Meanwhile, in step 130, if the fuse is disconnected, i.e., the developing machine has not just been replaced, the current applied through the transistor 71 is applied to the diode 72. Therefore, the diode 72 is turned on. And if the current is input through the diode 72 to the CPU 10, the CPU 10 identifies the disconnection of the fuse 60, and thereby passes to step 310.

However, if instep 230, if the fuse 60 is not disconnected, that is, the fuse did not blow upon application of current in S220, one is added to the printing counter number and a predetermined standard number N of the printing counter is compared with the printing counting number in order to check whether the counting number is same with the standard number N (S232). Standard number N limits the number of attempts to blow the fuse, and the value chosen for N is an appropriate number for the particular design. If the counting number is same with the standard number N, the engine part 30 is controlled to output an error message on the operational panel 50 (S233). Such an error message might be, for example, "Call service technician" or "initializing printing counter failed". If the counting number is less than the standard number N, the process is returned to the step 220.

Figure 3:
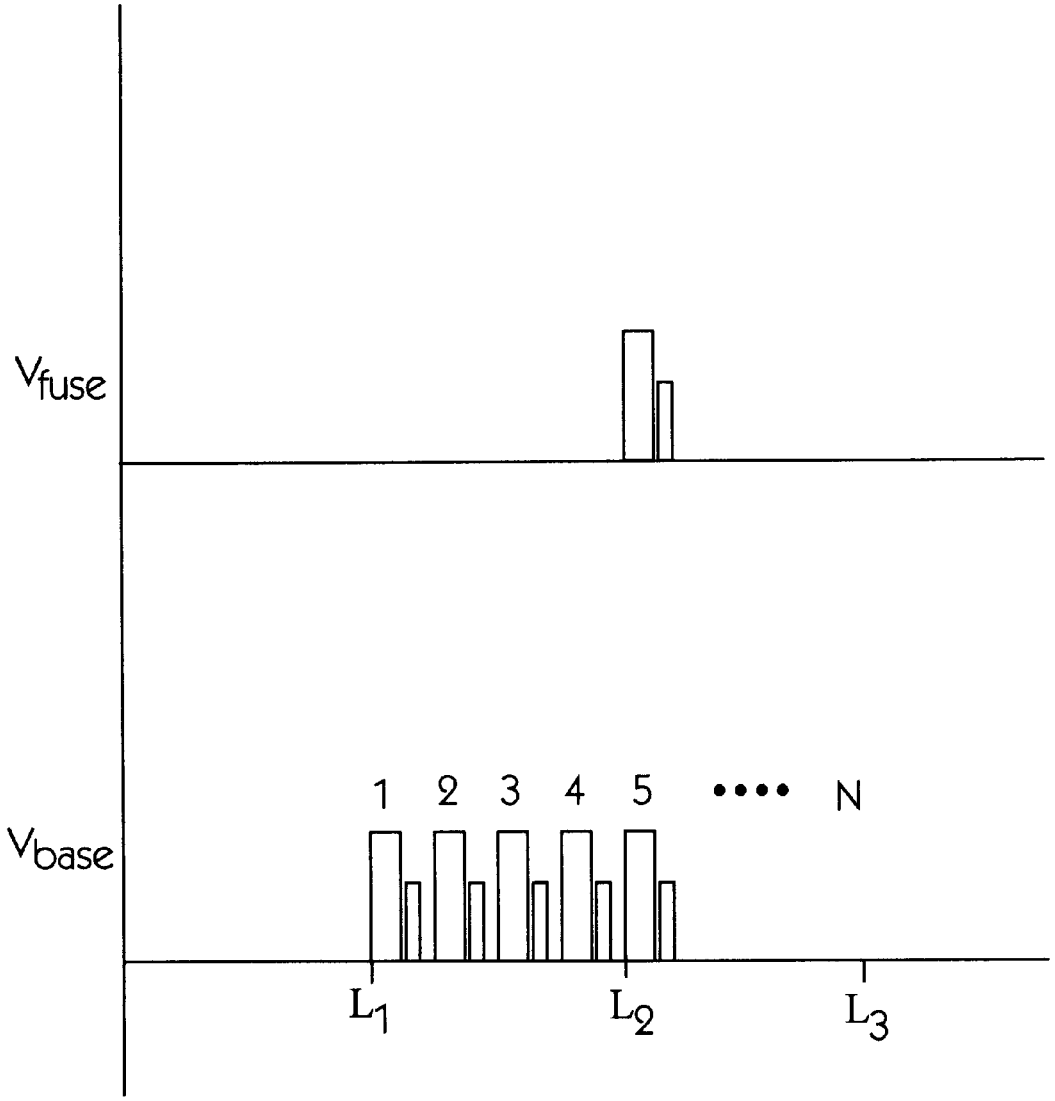
FIG. 3 illustrates an exemplary set of voltage waveforms generated during the operation of the present invention.

FIG. 3 illustrates an exemplary set of voltage waveforms which might occur upon carrying out steps S220, S230, S231 and S232. In FIG. 3, $V_{base}$ is the voltage applied to base of transistor 71 from terminal 78 of CPU 10. $V_{fuse}$ is the voltage drop across fuse 60. At time $t_1$, an application of the second level of current of step S220 is seen. In this case, the fuse does not blow, and there is no voltage drop across the fuse. Then step S230 is performed with the first level of current to determine if the fuse is blown. This process is performed four times in this example without blowing the fuse. At $t_2$, a fifth attempt to blow the fuse is successful, and a voltage drop is seen across the fuse. Step 230 then leads to determination that the fuse is blown, and step 220 is not repeated. Time $t_3$ is the time at which S220 and S230 would have been repeated N times if the fuse had not blown, at which point step S233 would be performed.

Therefore, according to the present invention, a user can identify the replacement of the developing machine so as to decide the replacement time of the developing machine without the separate sensor.

This invention has been described above with reference to the aforementioned embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. An apparatus to identify a replacement of a developing machine, comprising:

a fuse which is disposed at a desired position of the developing machine;

a switching part which is disposed at a desired position of a printer body corresponding to the fuse for applying a level of current to the fuse according to a control signal so as to disconnect the fuse;

a control unit for outputting a control signal to the switching part so as to check whether the fuse is disconnected when a warming-up operation of a printer is started, for determining if the developing machine has been replaced, and for outputting a control signal to a power controller so as to disconnect the fuse if the fuse is not disconnected and then initializing a printing counter.

2. The apparatus according to claim 1, said control unit comprising:

a central processing unit which entirely controls the apparatus and a RAM which initializes the printing counter if the fuse is disconnected by the control signal.

3. The apparatus according to claim 1, said switching part comprising:

a transistor of which a base is connected with an output terminal and a collector is connected with a power terminal and an emitter is connected with the fuse so that the switching part is turned on if a first level of current is supplied from the CPU and a second level of current is supplied from the power terminal so as to disconnect the fuse; and a diode of which a cathode is connected with an input terminal of the CPU and an anode is connected with the transistor and a node of the fuse so that the diode is turned on by the second level of current through the transistor if the fuse is disconnected.

4. A method to identify a replacement of a developing machine, comprising steps of:

checking whether a fuse is disconnected by outputting, a signal from a central processing unit of a printer to the fuse when a warming-up operation of the printer is started;

disconnecting the fuse and initializing a printing counter if the fuse is not disconnected; and increasing a number of the printing counter by one whenever one paper is printed and storing the number in a storing means.

5. A method to identify a replacement of a developing machine, comprising steps of:

checking whether a fuse is disconnected when a warming-up operation of a printer is started; disconnecting the fuse and initializing a printing counter if the fuse is not disconnected;

increasing a number of the printing counter by one whenever one paper is printed and storing the number in a storing means; and outputting the number of the printing counter stored in the storing means if the user inputs an order of checking the number of the printing counter.

6. The method according to claim 5, said step of checking whether a fuse is disconnected comprising steps of:

initializing the number of the printing counter and applying a power to the fuse so as to disconnect the fuse;

checking whether the fuse is disconnected;

increasing the number of the printing counter if the fuse is not disconnected, and comparing a predetermined standard number with the counting number; and outputting an error message if the counting number is same with the standard number, and disconnecting the fuse if the counting number is less than the standard number.

7. An electrophotographic apparatus, comprising:

a developing machine replacably installed in the electrophotographic apparatus;

a fuse disposed on one side of said developing machine;

a switching part in the body of the printer electrically connected to said fuse, for applying current to said fuse, said switching part comprising a transistor, the collector of said transistor connected with a power terminal, and the emitter connected with said fuse; and a control unit connected to said switching part, the base of said transistor connected with an output of said control unit, for determining if said fuse is blown and for controlling the application of current from said switching part to said fuse.

8. The electrophotographic apparatus of claim 7, further comprising:

a printing counter for counting the number of pages printed since the printing counter was last initialized; and means in said control unit for initializing said printing counter when said fuse is determined to not be blown.

9. The electrophotographic apparatus of claim 7, further comprising:

a diode, the anode of said diode connected to a node between said emitter and said fuse, and the cathode of said diode connected to an input of said control unit.

10. The electrophotographic apparatus of claim 7, further comprising:

an operational panel connected to said control unit, for receiving user inputs to the control unit.

11. A method of operating an electrophotographic apparatus, comprising the steps of:

when said electrophotographic apparatus starts warming up, checking the integrity of a fuse mounted on a developing machine of the electrophotographic apparatus by outputting a signal from a central processing unit of the electrophotographic apparatus to the fuse;

when the fuse is found to be connected, then initializing a printing counter and applying a current to the fuse to blow the fuse; and incrementing the printing counter with each page printed by the electrophotographic apparatus, for determining when the developing machine should be replaced.

12. The method of claim 11, further comprising the step of:

installing a new developing machine having an intact fuse mounted on one side, into the electrophotographic apparatus.

13. The method of claim 11, said step of applying a current to the fuse further comprising the steps of:

after applying the current to the fuse, rechecking the integrity of the fuse;

when the fuse is not blown, then repeating said steps of applying a current and rechecking the integrity of the fuse for a predetermined number of times; and when the fuse is not blown after the predetermined number of times, outputting an error message.

14. The method of claim 13, said step of applying current and rechecking the integrity of the fuse further comprising the steps of:

incrementing the printing counter; and comparing the printing counter to the predetermined number to determine when the step has been performed for the predetermined number of times.

15. The method of claim 13, further comprising the steps of:

when said electrophotographic apparatus starts warming up, and when the fuse is found to be connected, first initializing a second counter;

incrementing a second counter after each step of applying a current; and determining when the step has been performed for the predetermined number of times by comparing the second counter to the predetermined number.

16. The method of claim 11, further comprising the step of: after applying a current to blow the fuse, initializing the printing counter.

17. A method of operating an electrophotographic apparatus, comprising the steps of:

when said electrophotographic apparatus starts warming up, checking the integrity of a fuse mounted on a developing machine of the electrophotographic apparatus;

when the fuse is found to be connected, then initializing a printing counter and applying a current to the fuse to blow the fuse; and then when the fuse is found to be disconnected; incrementing the printing counter with each page printed by the electrophotographic apparatus, for determining when the developing machine should be replaced.

* * * * *